US007618532B2

(12) United States Patent
Worth

(10) Patent No.: US 7,618,532 B2
(45) Date of Patent: Nov. 17, 2009

(54) AROMATIC DRAIN DEVICE

(75) Inventor: Thomas W. Worth, Garner, NC (US)

(73) Assignee: Mark A. Mangrom, Raleigh, NC (US)

( * ) Notice: Subject to any disclaimer, the term of this patent is extended or adjusted under 35 U.S.C. 154(b) by 0 days.

(21) Appl. No.: 12/246,411

(22) Filed: Oct. 6, 2008

(65) Prior Publication Data

US 2009/0026285 A1 Jan. 29, 2009

Related U.S. Application Data

(62) Division of application No. 11/382,541, filed on May 10, 2006.

(51) Int. Cl.

| | |
|---|---|
| ***E03F 5/14*** | (2006.01) |
| ***E03D 9/02*** | (2006.01) |
| ***A61L 9/00*** | (2006.01) |
| ***A61L 9/04*** | (2006.01) |

(52) U.S. Cl. ..... 210/164; 4/292; 4/222.1; 239/57; 239/60

(58) Field of Classification Search ..... None
See application file for complete search history.

(56) References Cited

U.S. PATENT DOCUMENTS

| | | | | | |
|---|---|---|---|---|---|
| 769,001 | A | * | 8/1904 | Lawrence | 4/291 |
| 852,044 | A | * | 4/1907 | Van Der Minden | 4/291 |
| 965,836 | A | * | 7/1910 | Ray | 210/315 |
| 1,035,733 | A | * | 8/1912 | Pierce | 4/291 |
| 1,515,073 | A | * | 11/1924 | Savard | 4/289 |
| 1,612,588 | A | * | 12/1926 | Lacoste | 4/291 |
| 1,756,290 | A | * | 4/1930 | Hibner | 4/289 |
| 1,880,962 | A | * | 10/1932 | Koppelman | 4/309 |
| 1,966,074 | A | * | 7/1934 | Fuld | 4/222.1 |
| 2,046,214 | A | * | 6/1936 | Selig | 4/222.1 |
| 2,059,524 | A | * | 11/1936 | Hoffman | 4/222.1 |
| 2,087,341 | A | * | 7/1937 | Farmer | 4/222.1 |
| 2,087,592 | A | * | 7/1937 | Chesnut | 510/195 |
| 2,182,795 | A | | 12/1939 | Day | |
| 2,191,686 | A | * | 2/1940 | Shenk | 210/86 |
| 2,246,012 | A | * | 6/1941 | Sanders | 210/163 |
| 2,337,331 | A | * | 12/1943 | Kirschner | 4/289 |
| 2,498,502 | A | * | 2/1950 | O'Brien | 4/629 |
| 2,505,305 | A | * | 4/1950 | Schaefer | 4/289 |
| 2,654,097 | A | * | 10/1953 | Epstein | 4/291 |
| 2,689,017 | A | | 9/1954 | Schmid | |
| 3,112,499 | A | | 12/1963 | Thornton | |
| 3,469,700 | A | * | 9/1969 | Johnson | 210/238 |
| 3,597,772 | A | * | 8/1971 | Leavitt et al. | 4/222 |
| 3,713,539 | A | | 1/1973 | Thompson et al | |
| 3,760,429 | A | * | 9/1973 | Brownstein | 4/222.1 |

(Continued)

FOREIGN PATENT DOCUMENTS

| | | |
|---|---|---|
| JP | 10159147 A | 6/1998 |

(Continued)

*Primary Examiner*—Robert James Popovics
(74) *Attorney, Agent, or Firm*—The Parker Law Office, PLLC

(57) ABSTRACT

An aromatic drain device comprising a perforate retaining device defining a volume for retaining an aromatic media therein, the retaining device releasably secured to a removable drain cover and positioned to extend below the drain cover into the cavity defined by the floor drain wall.

2 Claims, 2 Drawing Sheets

U.S. PATENT DOCUMENTS 3,982,289 A * 9/1976 Robbins ..... 4/292
4,103,367 A * 8/1978 Kaufer ..... 4/222
4,135,261 A * 1/1979 Uhrman ..... 4/222
4,224,701 A 9/1980 Huang
4,318,193 A 3/1982 Bayer et al.
RE31,561 E * 4/1984 Thompson ..... 4/290
4,459,209 A * 7/1984 Broadwater ..... 210/167.16
4,574,400 A * 3/1986 Annowsky ..... 4/222.1
5,019,346 A * 5/1991 Richter et al. ..... 422/28
5,037,541 A 8/1991 Ruey-Jang et al.
5,062,735 A 11/1991 Gaudin
5,165,119 A * 11/1992 Yamato ..... 4/309
D332,302 S * 1/1993 Brown ..... D23/261
5,365,616 A * 11/1994 Morad ..... 4/309
D353,445 S * 12/1994 Morad ..... D23/261
5,486,287 A 1/1996 Murphy
5,695,222 A * 12/1997 Hodges ..... 285/3
6,016,579 A * 1/2000 Erbs ..... 4/631
6,067,669 A * 5/2000 Peterson et al. ..... 4/287
6,108,828 A * 8/2000 Cheng ..... 4/287
6,197,321 B1 3/2001 Richter et al.
6,200,484 B1 3/2001 McInnis
6,202,749 B1 * 3/2001 Adams et al. ..... 166/227
6,254,770 B1 * 7/2001 Remon ..... 210/163
6,263,518 B1 * 7/2001 Magtanong ..... 4/289
6,269,490 B1 * 8/2001 Suski et al. ..... 4/309
6,315,896 B1 * 11/2001 Johnson ..... 210/164
6,340,120 B1 * 1/2002 Seymour ..... 239/59
6,403,032 B1 6/2002 Abercrombie et al.
6,491,814 B1 * 12/2002 Wheeler ..... 210/164
6,537,447 B2 * 3/2003 Remon ..... 210/163
6,537,448 B2 3/2003 Houk
6,588,029 B2 7/2003 Mullings
6,920,653 B2 * 7/2005 Selover ..... 4/507
6,927,199 B2 8/2005 Takemura et al.
7,011,746 B2 3/2006 Bockmann
7,098,174 B2 * 8/2006 Takemura et al. ..... 510/195
7,150,576 B1 * 12/2006 Kambeyanda ..... 401/292
2004/0182763 A1 9/2004 Bockmann
2005/0135979 A1 * 6/2005 Gootter ..... 422/266
2007/0262006 A1 * 11/2007 Worth ..... 210/164
2008/0168596 A1 * 7/2008 Findlay et al. ..... 4/287
2009/0026285 A1 * 1/2009 Worth ..... 239/57

FOREIGN PATENT DOCUMENTS

JP 2001073431 A 3/2001

* cited by examiner

SEC. BB

AROMATIC DRAIN DEVICE

CROSS-REFERENCE TO RELATED APPLICATIONS

This application is a DIVISIONAL of prior non-provisional application Ser. No. 11/382,541, filed May 10, 2006, which is hereby incorporated by reference in its entirety.

This is a DIVISIONAL of application Ser. No. 11/382,541, filed May 10, 2006, publication number US 2007-0262006 A1, which is hereby incorporated by reference in its entirety.

BACKGROUND OF THE INVENTION

1. Field of Invention

This invention relates generally to a device positioned inside a floor drain for deodorizing public facilities and the like.

2. Description of the Prior Art

Many public facilities having floor drains suffer from odor problems emanating from the floor drain. This problem is especially prevalent in public restrooms. As facilities are cleaned, dirt, grime, and bacteria collect in the floor drain p-trap. The water in the p-trap quickly becomes dirty and emanates foul odor into the room and adjacent areas.

Currently, the prevailing solution to this problem is the use of sanitizing liquids. These liquids are typically poured down the floor drain on a regular basis. However, the solution is quickly washed down the drain and out of the trap with subsequent cleanings. Additionally, the sanitizing liquid does not provide continuous aroma to the room.

Other common solutions include the use of wall-mounted, time-release deodorizer sprayers. These devices systematically release aroma into the room to mask odors at predetermined time intervals. These systems also do not provide a continuous release of aroma into the room. While these devices mask foul odors immediately following discharge, the active aromatic agents quickly disperse into the room, failing to effectively mask or eliminate the odors.

Yet other devices attempt to place deodorizing and sanitizing agents inside the drain. These devices typically address either sink drains or floor drains. Most of these devices require special drain modifications to hold the device, increasing expense to the owner and making them impractical for contractor installation. These devices may also have the tendency to aggravate drain problems by catching dirty water around the device.

SUMMARY OF THE INVENTION

The present invention is directed to an aromatic drain device attachable to and suspending below a floor drain cover. The device comprises a retaining device that retains an aromatic media that continually releases pleasant fragrances to mask or eliminate foul odors emanating from the floor drain. The device provides for extending release periods and is simple and easy to change without obstructing drain flow.

It is therefore an object of the present invention to provide a novel aromatic device for masking or eliminating odors emanating from the floor drain.

It is an object of the present invention to provide an aromatic device easily securable to a floor drain.

It is an object of the present invention to provide an aromatic drain device that can utilize a variety of aromatic media.

It is an object of the present invention to provide an aromatic device that provides continual aromatic action for an extending duration.

It is an object of the present invention to provide an aromatic drain device providing quick, easy replacement of aromatic media.

To achieve the foregoing objects, and in accordance with the purpose of the invention as broadly described herein, the present invention provides an aromatic drain device securably attaching to a drain cover.

In a first aspect, the device comprises a retaining device securably attached to, and suspending below, a drain cover, wherein the retaining device is formed of perforated material and defines a volume having an aromatic media retained inside so that air flows through the device carrying fragrance from the aromatic media to the room in which the drain is located.

In a second aspect, the device comprises a retaining device that may be easily and quickly removed from the floor drain facilitating quick replacement of aromatic media, wherein the retaining device holds either solid, gel based, or liquid based aromatic media.

In a third aspect of the invention, the device comprises a retaining device separably formed into a bottom section releasably securing to a top bottom section and forming an air gap there-between, whereby the bottom section retains the aromatic media and is quickly removable to facilitate changing of the aromatic media.

In a fifth aspect of the invention, the device comprises a retaining device having a top section that diverts water flowing down through the drain cover away from the retaining device and the aromatic media held therein.

The present invention will now be described with reference to the following drawings, in which like reference numbers denote the same element throughout.

DESCRIPTION OF THE PREFERRED EMBODIMENT

Figure 1:
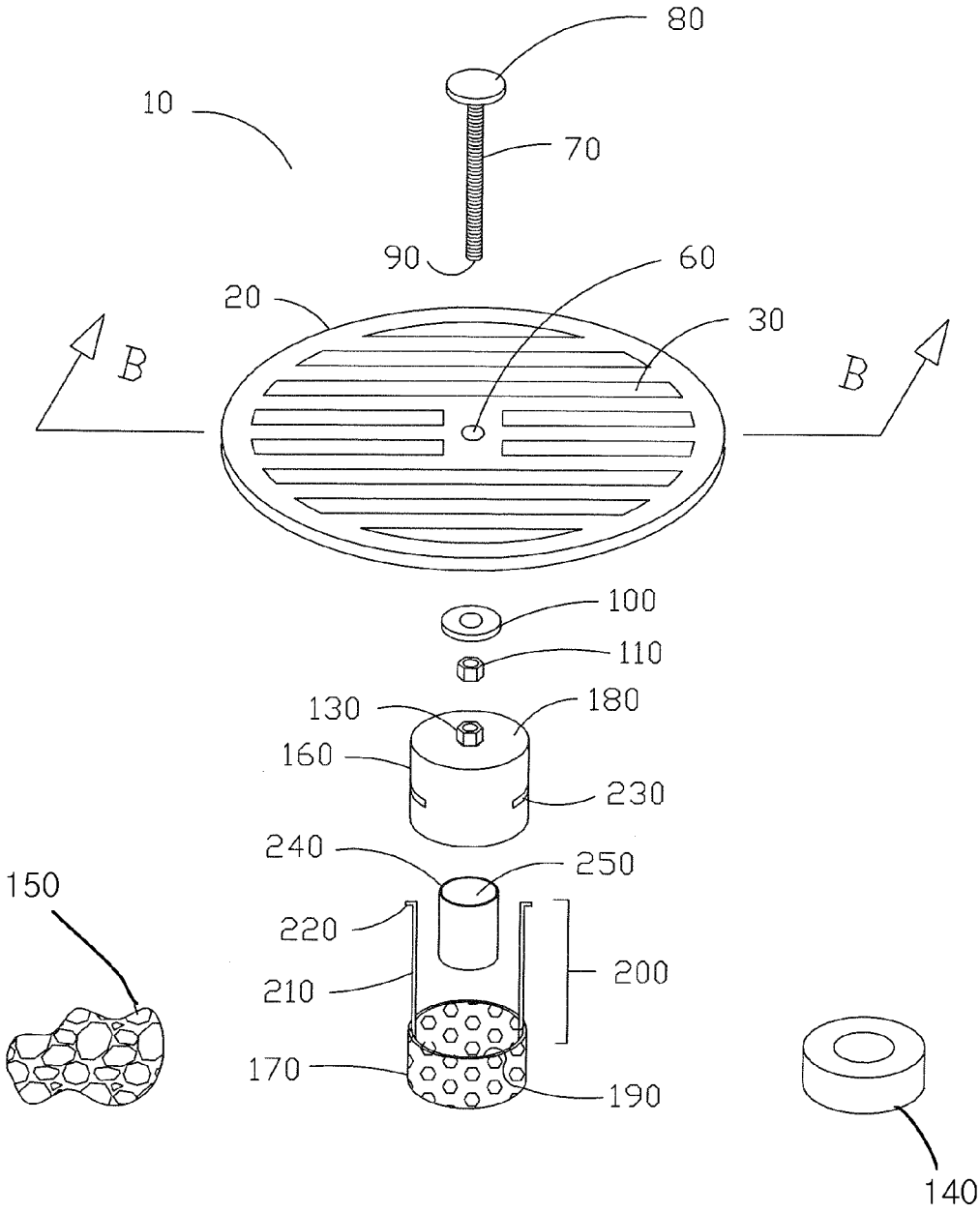
FIG. 1 is an assembly view of an embodiment of the present invention having a top section and a bottom section.
Figure 2:
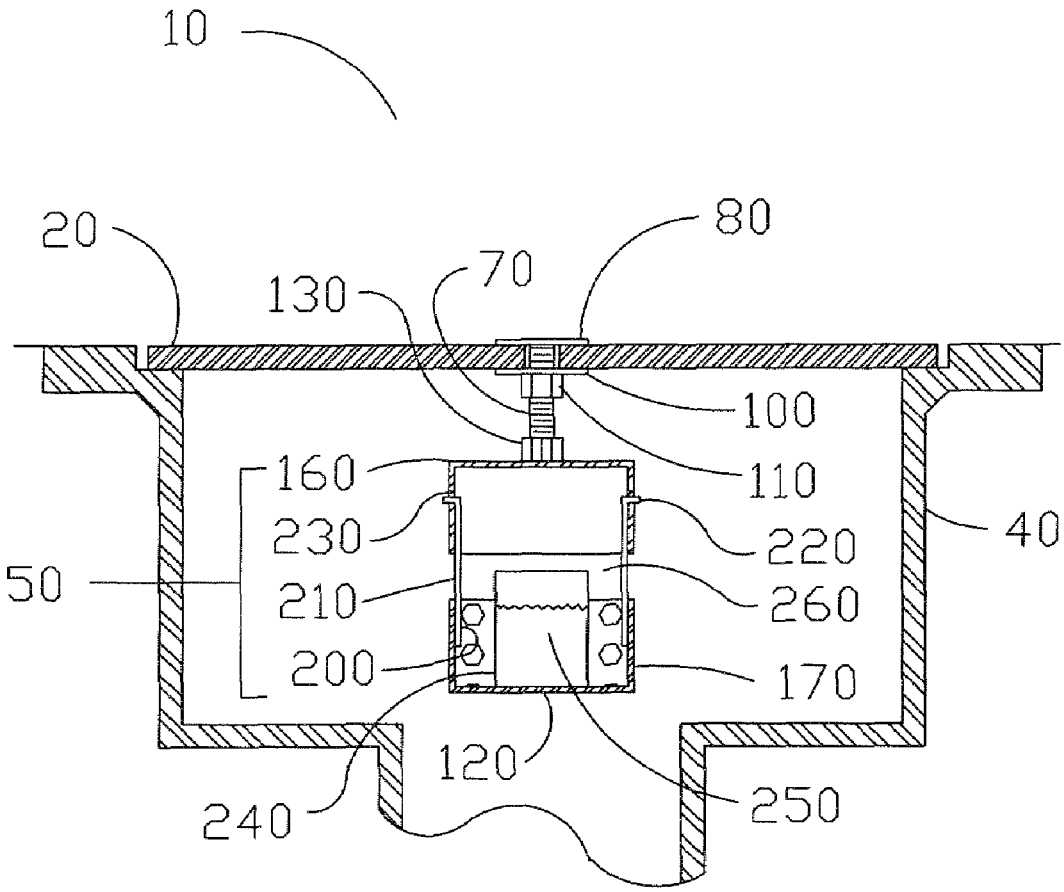
FIG. 2 is a cross-sectional elevation view of an embodiment of the present invention having a top section and a bottom section.

Referring now to the drawings in greater detail, FIG. 1 and FIG. 2, an aromatic floor drain device 10 is shown. A floor drain cover 20 has a plurality of drain openings 30 formed therein. The drain openings 30 allow water and debris washed from the floor to pass through the openings and into the floor drain 40. The drain cover 20 removably secures to a floor drain 40. A retaining device 50 defining a volume therein releasably secures to the drain cover 20. In the illustrated embodiment, the drain cover 20 has a bolt opening 60 centrally formed therein. The bolt opening 60 is adapted to receive an elongated threaded bolt 70 having a flat head 80 and a free end 90. The bolt opening 60 receives the threaded bolt 70 so that the flat head 80 is essentially flush with the top of the drain cover 20 while the free end 90 extends below the drain cover 20 and into the cavity defined by the floor drain 40. The bolt opening 60 may be countersunk to allow the flat head 80 to recess into the top of the drain cover 20. Though not illustrated, this arrangement further ensures that the flat head 80 is not likely to present a tripping hazard. Alternatively, the threaded bolt 70 may be placed through one of the drain openings 30 in lieu of placement in a specially formed bolt opening 60. If this alternative arrangement is utilized, the threaded bolt 70 should be secured in a central location on the drain cover 20.

A washer 100 and lock nut 110 engage the threaded bolt 70 on the bottom side of the drain cover 20 that is adjacent to the floor drain 40 cavity. The lock nut 110 secures the threaded bolt 70 to the drain cover 20. The provided retaining device 50 is preferably cylindrically shaped defining a cylindrical volume therein. The retaining device 50 has a bottom 120. The retaining device 50 has a sufficient number of perforations or openings formed therein to allow liquids and solids that would pass through the drain cover 20 to pass freely through the retaining device 50. This may be achieved by using a retaining device 50 constructed of wire mesh having large diameter openings, or other solid materials having perforations sufficiently large to allow the passage of the liquids and solids.

The retaining device 50 has a device securing means 130 for securing the retaining device 50 to the drain cover 20 bottom. The device securing means 130 is a nut centrally located and affixed on the retaining device 50. The nut is adapted to engage the free end 90 of the threaded bolt 70. This arrangement allows a user to easily screw the retaining device 50 onto the threaded bolt 70 thereby securing the retaining device 50 to the drain cover 20. In this arrangement, the free end 90 of the threaded bolt 70 may be adapted to receive a cotter key or similar securing means to provide a secondary retention means to ensure that the retaining device 50 does not accidentally become unsecured and fall into the drain.

An aromatic media is provided that is adapted in shape to fit inside the volume defined by the retaining device 50. The aromatic media may take one of many forms. In the illustrated embodiment, three different forms are illustrated. One form is a deodorizing aromatic solid 140 preferably having a cylindrical shape. The aromatic solid 140 may be composed of any of a number of deodorizing solids that are well known to those skilled in the art of deodorizing and sanitizing chemicals. The aromatic solid 140 is preferably of a type that sublimates so that the deodorizing aroma is continuously emitted into the air. Additionally, sanitizing agents may be impregnated into the aromatic solid 140 so that as water flows through the device 10 and over the aromatic solid 140 the sanitizing agent is released. Alternatively, a sponge 150 soaked with an aromatic liquid may be placed inside the retaining device 50. The aromatic liquid 250 evaporates from the sponge 150 emitting a pleasant aroma into the air. The sponge 150 may be adapted to form a cylindrical shape. Other embodiments could include specially shaped containers 240, adapted to fit within the volume defined by the retaining device 50, holding aromatic liquid 250 or gelatinous-based deodorizing agents.

In operation, the device 10 is able to provide elongated periods wherein pleasant aromas are released, effectively masking or eliminating the foul odors emanating from the floor drain 40. To operate the device 10, the threaded bolt 70 secures to the drain cover 20 with the flat head 80 flush with the drain cover 20 and floor surface. The free end 90 of the threaded bolt 70 extends perpendicularly and outwardly from the bottom surface of the drain cover 20 and into the cavity defined by the floor drain 40. The user places the aromatic media into the open end of the retaining device 50. The aromatic media generally rests on the bottom 120 of, and inside the volume defined by, the retaining device 50. The threaded bolt 70 inserts into the open end of the retaining device 50, through the opening in the bottom 120, and engages the device securing means 130. The user turns the retaining device 50 to engage the device securing means 130 nut onto the free end 90 of the threaded bolt 70. The user continues to screw the retaining device 50 until the open end of the retaining device 50 is flush against the bottom side of the drain cover 20. The retaining device 50 should be screwed hand tight to ensure a snug fit. The cotter key or other secondary retaining device 50 is placed on the threaded bolt 70 free end 90. Finally, the drain cover 20 engages the floor drain 40 using the removable securing means provided with the drain cover 20. To replace the aromatic media, the drain cover 20 is simply removed, the secondary retaining device 50 is removed (if provided), and the retaining device 50 is unscrewed from the threaded bolt 70 allowing the user to replace the aromatic media.

In this embodiment, the retaining device 50 is also preferably cylindrically shaped and separably formed into a top section 160 and a bottom section 170. The top section 160 is cylindrically shaped having an open end while the other end is closed defining a top 180. In the illustrated embodiment, the device securing means 130 is a nut centrally and fixedly attached to the top section 160 top 180. In this embodiment the device securing means 130 should secure the top section 160 to the drain cover 20. Other suitable means may also be used to fixedly secure the top section 160 to the underside of the drain cover 20. The top section 160 is preferably formed of a solid plastic or sheet metal. The top section 160 is adapted to effectively divert water away from the device 10 and away from the inner volume defined by the device 10.

The bottom section 170 is also preferably cylindrically shaped having a wall 190 and a closed end forming a bottom 120. The other end of the bottom section 170 defines an opening. The bottom section 170 is fabricated from a perforated material permitting any water or debris that washes into the bottom section 170 to flow freely through and out of the retaining device 50. A plurality of elongated, springy retainer clips 200 have one end affixed to the bottom section wall 190, a body portion 210, and a catch 220. The body portion 210 of the bottom section 170 extends beyond the opening defined by the bottom section wall 190 in a direction perpendicular to the bottom 120 and parallel with the bottom section 170 axis. The end spaced distally from the bottom section 170 is adapted into a catch 220. In the illustrated embodiment, the catch 220 extends radially outwardly from the bottom section 170 axis in a plane perpendicular to the body portion 210.

The retaining device 50 top section 160 is adapted to securably receive the catch 220 from each retainer clip 200. In the illustrated embodiment, the top section 160 has a series of slots 230 formed therein for receiving the retainer clips 200. In operation, a user depresses the body portion 210 of the retainer clips 200 radially inward so that the catch 220 of each clip can be inserted into the open end of the top section 160. When pressure is released, the body portion 210 springs back to shape inserting the catch 220 into the corresponding slot 230. The catch 220 is of sufficient length to extend beyond the top section 160 outer surface. The retainer clip 200 should be constructed of a durable, flexible, shape-retaining material capable of quickly springing back to shape after depression or deformation of normal use. The retainer clips 200 provide for easy removal and secure attachment of the bottom section 170 to the top section 160. The catch 220 ensures that the bottom section 170 securably attaches to the top section 160 and does not accidentally dislodge and fall into the drain.

As with the first described embodiment, a sponge 150 soaked with aromatic liquid or an aromatic solid 140 may be placed into the retaining device 50. Additionally, this second embodiment is well suited to hold a container 240 of aromatic liquid 250. Since the top section 160 diverts liquids pouring through the drain cover 20 away from the device 10, dirty water and debris washed from the facility floor into the drain cannot enter the container 240 held inside the retaining device 50. Thus, an aromatic liquid 250 will not wash out of the container 240 held inside the retaining device 50. Whether an aromatic liquid 250 is used that evaporates into the air, or an aromatic solid 140 that sublimates, the perforations in the bottom section 170 allow treated air to exit the retaining device 50 and mask the foul odors emanating from the door drain. To facilitate this action, the body portion 210 of the retainer clips 200 should be sufficiently long to allow the bottom section 170 to hang from the top section 160, forming a gap 260 between the top section 160 and bottom section 170 through which air can freely circulate.

In operation, the threaded bolt 70 is securably attached to the drain cover 20 as previously described. The top section 160 is threaded onto the free end 90 of the threaded bolt 70. A cotter key or set screw may also be used to secure the top section 160 in place. An appropriate aromatic media inserts into the bottom section 170 open end and rests on the bottom 120. The body portions 210 are depressed while each catch 220 inserts into the open end of the top section 160. The retainer clips 200 are released and the body portion 210 springs back to shape inserting the catch 220 of each retaining clip into the corresponding slot 230 in the top section 160. Finally, the drain cover 20 engages the floor drain 40 using the removable securing means provided with the drain cover 20. To replace the aromatic media, the drain cover 20 is removed, the body portion 210 of the retainer clips 200 are depressed, and the bottom section 170 is removed from the top section 160. A new aromatic media replaces the spent aromatic media.

As has been demonstrated, the present invention provides a novel aromatic drain device and method of use continual masking and elimination of odors emanating from floor drains for extended durations. The present invention could be used with a variety drain covers and floor drain designs. Additionally, a variety of aromatic media could be used including those having solid, liquid or gel bases. The prior art does not provide teachings in an aromatic drain device attached to a floor drain cover that provides continual, extended aromatic action without presenting a drain clogging problem. Further, the prior art does not teach an aromatic drain device that effectively utilizes a variety of aromatic media in the same device. Further, the prior art does not teach an aromatic drain device for floor drains that securely attaches to a drain cover without requiring special modification to the modification of the floor drain or use of special manufactured floor drain components.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. An aromatic drain device comprising:

a drain cover releasably secured to a floor drain having a plurality of openings formed therein for allowing the passage of liquid there-through;

a threaded bolt having a flat head and a free end, the free end extended downwardly through one of the plurality of openings and having a lock nut securing the threaded bolt to the drain cover;

a cylindrically shaped retaining device defining a volume therein and retaining an aromatic media, the retaining device formed in two separable parts comprising a bottom section and a top section, the bottom section comprising a perforated wall, a closed end defining a perforated bottom, and an opening at the other end defined by the perforated wall, the top section comprising a wall, a closed end defining a top, and the other end open, and a plurality of slots formed into the wall;

a lock nut centrally affixed to the top section top engaging the threaded bolt free end;

a plurality of elongated clips each having one end affixed to the bottom section perforated wall, a body portion extending axially outwardly from the opening, and a catch, wherein each catch releasably engages into a corresponding one of the plurality of slots;

the retaining device positioned to extend from and below the drain cover and into a cavity defined by the floor drain wall.

2. An aromatic drain device for providing a pleasant fragrance for masking or elimination of odors emanating from a floor drain comprising:

a floor drain cover releasably secured to the floor drain having a plurality of openings formed therein for allowing the passage of liquid there-through, a perforated retaining device releasably secured to the drain cover, the retaining device positioned to extend below the drain cover and into a cavity defined by the floor drain wall, the retaining device further defining a volume therein and retaining an aromatic media;

wherein the retaining device is formed in two separable parts comprising a bottom section and a top section and including a means of releasably joining the top section and the bottom section;

the bottom section further comprises a perforated cylindrical wall, a closed end defining a bottom, the wall defining an opening on the other end;

the top section further comprising a cylindrical wall, a closed end defining a top adapted to divert water away from the retaining device, and the other end open so that the open end of the top section is adjacent the bottom section opening when the top section and bottom section are releasably joined;

the means of releasably joining the top section and the bottom section comprises a plurality of elongated clips having one end affixed to the wall, a body portion extending axially outwardly from the opening, and a catch, the top section comprises a series of slots wherein each slot is adapted to receive a catch of a corresponding one of the plurality of elongated clips, so that when the body portions are depressed the catch disengages releasing the bottom section from the top section, and when the body portions are free the catches insert upwardly into the top section open end and engage into the plurality of slots.

* * * * *